US005293819A

United States Patent [19]

Fukuda

[11] Patent Number: 5,293,819

[45] Date of Patent: Mar. 15, 1994

[54] INKING ARRANGEMENT

[76] Inventor: Manabu Fukuda, 122, Takano 1-Chome, Misato-Shi, Saitama-Ken, Japan

[21] Appl. No.: 888,531

[22] Filed: May 26, 1992

[30] Foreign Application Priority Data

Feb. 20, 1992 [JP] Japan ..... 4-033523

[51] Int. Cl.[5] ..... B41F 31/06; B41F 31/32

[52] U.S. Cl. ..... 101/350

[58] Field of Search ..... 101/350, 363, 349, 364, 101/365, 366, 207, 208-210, 425, 423

[56] References Cited

U.S. PATENT DOCUMENTS

| | | | |
|---|---|---|---|
| 4,527,479 | 7/1985 | Dahlgren et al. | 101/148 |
| 4,542,693 | 9/1985 | Mourrellone | 101/350 |
| 4,602,564 | 7/1986 | Sakamoto et al. | 101/350 |

FOREIGN PATENT DOCUMENTS

| | | | |
|---|---|---|---|
| 0061581 | 10/1982 | European Pat. Off. . | |
| 0116176 | 8/1984 | European Pat. Off. . | |
| 0149841 | 7/1985 | European Pat. Off. . | |
| 0182325 | 5/1986 | European Pat. Off. . | |
| 0225253 | 6/1987 | European Pat. Off. . | |
| 3716422 | 9/1988 | Fed. Rep. of Germany . | |
| 1401718 | 7/1964 | France | 101/349 |
| 2467700 | 4/1981 | France . | |
| 2-204039 | 8/1990 | Japan . | |
| 4-193536 | 7/1992 | Japan . | |
| 2100671 | 1/1983 | United Kingdom . | |

OTHER PUBLICATIONS

Patent Abstracts of Japan, vol. 014, No. 495 (M-1041) 29 Oct. 1990.

Patent Abstracts of Japan, vol. 016, No. 523 (M-1331) 27 Oct. 1992.

Patent Abstracts of Japan, vol. 014, No. 281 (M-0986) 18 Jun. 1990.

*Primary Examiner*—J. Reed Fisher

*Attorney, Agent, or Firm*—Bruce L. Adams; Van C. Wilks

[57] ABSTRACT

An inking arrangement has a structure in which a printing ink extracted from an inking source by an inking roller is transferred to an ink applying roller through an ink roller train including a plurality of inking rollers and the printing ink is then transferred to a scanning area of a plate cylinder from the ink applying roller. A doctor device is disposed above a top portion of an outer peripheral surface of the ink applying roller, the doctor device being circumscribed with the top portion at an acute angle on a roller rotating direction of the ink applying roller to scrape out an ink remaining on the outer peripheral surface of the ink applying roller as well as to clean the surface. A plurality of ink roller trains may be disposed so as to include, for example, a smoothing ink roller train and a finishing ink roller train, each including a doctor device circumscribing the outer peripheral surface of the ink applying roller contacting the plate cylinder. In this arrangement, the smoothing ink roller train may be composed as a unit rotatable around a spindle of one of the rollers so as to outwardly release the doctor device.

26 Claims, 3 Drawing Sheets

INKING ARRANGEMENT

BACKGROUND OF THE INVENTION

This invention relates to an inking arrangement used for a printing machine and is particularly concerned with an inking arrangement for feeding a printing ink to a plate cylinder.

In an inking arrangement used for a printing machine, a printing ink stored in an inkwell is transferred to ink applying rollers from an ink delivery roller through a train of inking rollers, and the printing ink is then scoured to a plate such as a plate cylinder or the like from the ink applying rollers.

In a prior art inking arrangement, a printing ink stored in an inkwell is extracted on an ink delivery roller and then guided to an inking roller train including a plurality of inking rollers combined therefor. The inking roller train comprises, in combination, an ink transfer roller for transferring the extracted printing ink in a proper quantity, scouring rollers for securing a fluidity of the printing ink by minimizing a change in concentration thereof, reciprocating rollers reciprocating axially at a constant width to distribute the printing ink uniformly without causing inhomogeneous regions, and ink applying rollers for settling the printing onto a scanning area of a plate such as a plate cylinder. In consideration of scour and transferability of the printing ink, the inking roller train includes metallic rollers and rubber rollers disposed alternately, thus aiding in achieving keeping the printing ink constant in concentration.

In a printing machine such as a sheet press, web press of the like, an inking arrangement in which a plate cylinder or the like is incorporated is set, a printing ink is scoured by the inking arrangement and applied to the plate cylinder, a printing paper is fed to the plate cylinder to which the ink is applied, and a pressure is applied to effect the paper to printing.

In the prior art inking arrangement, a plurality of inking rollers are combined to form a system linking the ink transfer roller to the ink applying rollers, and a printing ink is scoured by the inking roller train, thereby keeping the printing ink applied to the plate cylinder constant in concentration.

However, in the prior art inking arrangement, while the printing ink is transferred in succession to a lower stage side through the inking roller train, it is difficult to transfer the ink thoroughly to the inking rollers on the lower stage side, and thus there may be a case where the printing ink which could not be transferred to the inking roller on the lower stage side remains on a surface of the inking roller for applying the printing ink to the plate cylinder. The residual ink is introduced onto the plate cylinder, resulting in an unevenness in concentration of the printing ink, which may cause an non-homogeneous printing and an ink stain.

SUMMARY OF THE INVENTION

An object of this invention is to substantially eliminate the above-mentioned defects and drawbacks encountered in the prior art and to provide an inking arrangement capable of preventing insufficient printing ink concentration and ink strain from arising due to printing ink remaining on an ink applying roller and being suitable for providing a high grade artificial printing product.

Another object of this invention is to provide an inking arrangement which includes a doctor device for smoothing the ink distribution and cleaning the roller surface and which is capable of providing easy handling of the doctor device.

These and other objects can be achieved according to the present invention by providing an inking arrangement in which a printing ink extracted from an inking source by an inking roller is transferred to an ink applying roller through an ink roller train including a plurality of inking rollers, and the printing ink is then transferred to a scanning area of a plate cylinder from the ink applying roller, the improvement being that a doctor device is disposed above a top portion of an outer peripheral surface of the ink applying roller, the doctor device being circumscribed with the top portion at an acute angle with the roller rotating direction of the ink applying roller to scrape out any ink remaining on the outer peripheral surface of the ink applying roller as well as to clean the surface.

In a modified embodiment, there is provided an inking arrangement comprising an ink source in which a printing ink is stored;

an inking roller contacting the printing ink in the ink source;

an ink roller train contacting the inking roller, the ink roller train including an ink transfer roller contacting the inking roller for receiving the printing ink from the ink source, an ink scouring roller contacting the ink transfer roller for stabilizing the fluidity of the printing ink, a reciprocating roller contacting the scouring roller for smoothing the printing ink in a widthwise direction of the scouring roller, and an ink applying roller contacting the reciprocating roller and disposed in a final stage of the ink roller train;

a plate cylinder contacting the ink applying roller; and a doctor device disposed above a top portion of an outer peripheral surface of the ink applying roller, the doctor device being circumscribed with the top portion at an acute angle with the roller rotating direction of the ink applying roller to scrape out any ink remaining on the outer peripheral surface of the ink applying roller as well as to clean the surface, the reciprocating roller being circumscribed with the outer peripheral surface of the ink applying roller at a location further downward from a portion of the doctor device contacting the surface of the ink applying roller in the roller rotating direction thereof.

In another embodiment, there is provided an inking arrangement comprising:

an ink source in which a printing ink is stored;

an inking roller contacting the printing ink stored in the ink source;

ink roller train means contacting the inking roller, the ink roller train means including an ink transfer roller contacting the inking roller for receiving the printing ink from the ink source, a smoothing ink roller train and a finishing ink roller train, the smoothing ink roller train comprising an ink scouring roller contacting the ink transfer roller for stabilizing fluidity of the printing ink, a reciprocating roller contacting the scouring roller for smoothing the printing ink in a widthwise direction of the scouring roller, and a smoothing ink applying roller contacting the reciprocating roller through another inking roller and disposed in a final stage of the smoothing ink roller train, the finishing ink roller train comprising an ink scouring roller contacting the ink transfer roller, a reciprocating roller contacting the ink scouring roller for smoothing the printing ink in a widthwise direction of the scouring, and a finishing ink applying roller contacting the reciprocating roller through another inking roller and disposed in a final stage of the finishing ink roller train;

a plate cylinder contacting the smoothing ink applying roller and the finishing ink applying roller; and doctor devices disposed above outer peripheral surfaces of the smoothing and finishing ink applying rollers, the doctor devices being circumscribed with the outer peripheral surfaces of the smoothing and finishing ink applying rollers each at an acute angle with the roller rotating direction of the ink applying roller so as to scrape out ink remaining on the outer peripheral surface of the ink applying roller as well as to clean the surface.

In a further aspect, there is provided an inking arrangement comprising:

an ink source in which a printing ink is stored;

an inking roller contacting the printing ink stored in the ink source;

an ink roller train means contacting the inking roller, the ink roller train means including an ink transfer roller contacting the inking roller for receiving the printing ink from the ink source, a smoothing ink roller train and a finishing ink roller train, the smoothing ink roller train comprising an ink scouring roller contacting the ink transfer roller for keeping fluidity of the printing ink, a smoothing ink applying roller disposed in a final stage of the smoothing ink roller train and ink transfer belt means disposed between the scouring roller and the ink applying roller of the smoothing ink roller train, the belt means comprising a first roller contacting the ink scouring roller, a second roller contacting the smoothing ink applying roller, a belt stretched around outer peripheral surfaces of the first and second rollers to be rotatable so as to transfer the printing ink from the ink scouring roller to the smoothing ink applying roller through a rotation of the belt and a frame member connecting the first and second rollers, the finishing ink roller train comprising an ink scouring roller contacting the ink transfer roller, a reciprocating roller contacting the ink scouring roller for smoothing the printing ink in a widthwise direction of the scouring, and a finishing ink applying roller contacting the reciprocating roller through another inking roller and disposed in a final stage of the finishing ink roller train;

a plate cylinder contacting the smoothing ink applying roller and the finishing ink applying roller; and doctor devices disposed above outer peripheral surfaces of the smoothing and finishing ink applying rollers, the doctor devices being circumscribed with the outer peripheral surfaces of the smoothing and finishing ink applying roller each at an acute angle with the rotating direction of the ink applying roller so as to scrape out any ink remaining on the outer peripheral surface of the ink applying roller as well as to clean the surface.

In preferred embodiments of the inking arrangements according to the second and third embodiments mentioned above, each of the smoothing ink roller trains may be composed as a unit to be rotatable to outwardly release the doctor device so as to allow easy handling of the same.

According to the characters or structures of the inking arrangement of the present invention described above, the inking arrangement is provided with an ink roller train, or a plurality of ink roller trains in some aspects, and the doctor device is provided on the ink applying roller for applying a printing ink to a plate cylinder. The doctor device can scrape out the remaining ink to smooth and clean the roller surface. Therefore, an unevenness of concentration of the printing ink being prevented from arising on the ink applying roller is prevented, and a negative influence due to the unevenness of the concentration of the residual ink is also prevented, thus ensuring a clean printing, free from non-homogeneous printing regions and stain.

Further, the doctor device is provided with the doctor blade circumscribed acutely on the side where the roller rotates forward from a top portion of the ink applying roller and the doctor blade scrapes out to smooth the printing ink attached to the surface of the ink applying roller. Therefore, an unevenness of the ink concentration is prevented from arising on the side where the roller rotates forward.

Still further, in the inking arrangement according to the present invention, the inking roller train provided with the doctor device surrounded by each ink roller train is supported rotatably by a spindle of the roller to keep the doctor device releasable. Therefore, when the ink is changed or washed, the ink roller train is turned to release the doctor device and the doctor device can thus easily be loosened or demounted. Hence, the work for changing the ink shade or washing the ink can be simplified and smoothed. Further, damage or failure of the ink applying roller surface can be effectively prevented at the time of such work.

BRIEF DESCRIPTION OF THE DRAWINGS

For a better understanding of this invention and to show how the same is carried out, reference is made, by way of preferred embodiments, to the accompanying drawings, in which.

DESCRIPTION OF THE PREFERRED EMBODIMENTS

Preferred embodiments of an inking arrangement relating to this invention will now be described hereunder with reference to the accompanying drawings.

Figure 1:
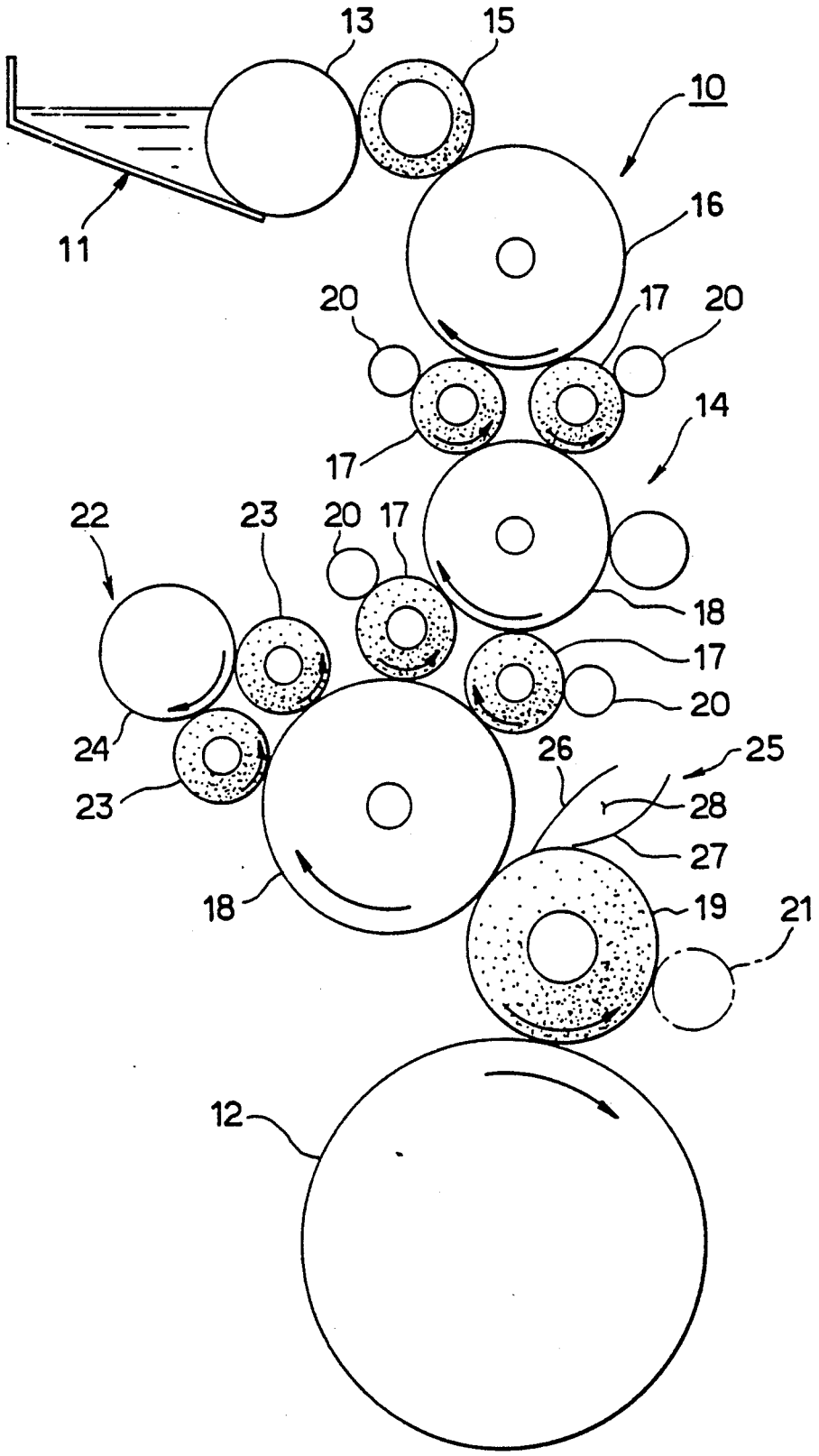
FIG. 1 is an illustrated arrangement representing a first embodiment of an inking arrangement according to this invention.

First, referring to FIG. 1 representing a first embodiment of this invention, an inking arrangement 10 is intended for use for printing machines such as sheet presses, web presses and the like, and in the inking arrangement 10, a printing ink stored in an inkwell 11 is scoured in order to transfer it to a plate cylinder 12.

The printing ink stored in the inkwell 11 is extracted by an ink delivery roller 13 and guided to an inking roller train 14 combining a plurality of inking rollers to function as ink scouring, rollers. In consideration of a tack value, i.e., the tackiness, of the printing ink and further taking roller scour and transferability of the ink into consideration, the inking roller train 14 includes fundamentally rubber rollers and metallic rollers, respectively disposed alternately.

The rubber roller is that in which an iron core is covered with synthetic rubber, natural rubber or the like, the synthetic rubber employing mainly neoprene, thiokol and nitrile rubber superior in oil resistance.

The inking roller train 14 includes a rubber ink transfer roller 15 for transferring a printing ink extracted from the ink delivery roller 13 in a proper quantity, scouring rollers 16 and 17 for scouring the printing ink from the ink transfer roller 15 to keep a desired fluidity of the ink, a reciprocating roller 18 for reciprocating and smoothing the printing ink on the outer peripheral surface axially of the roller by a necessary width and a rubber ink applying roller 19 for shifting the printing ink to the plate cylinder 12. The scouring rollers 16 and 17 are composed of a metallic roller 16 and an intermediate rubber roller 17, respectively. A hardness of the rubber roller is 30 to 40 degrees in the case where, for example, the scouring roller 17 is operating as a tumbling roller and 25 to 30 degrees in the case where the ink applying roller 19 is operating as a driving rubber roller.

The reciprocating roller 18 is a driving metallic roller for scouring the printing ink axially of the roller and the metallic roller is reciprocated axially at a constant stroke.

It is possible, when desired, to locate a roller 21 for the ink applying roller 19 for smoothing the roller surface after the ink transfer or before the transfer for preventing unevenness of the concentration and drying of the roller surface. The roller 21 may be composed of a reciprocating roller for smoothing the ink.

A scraper device 22 may be disposed as occasion demands for the final stage side ink roller of the ink roller train 14, for example, the final stage reciprocating roller 18. The scraper device 22 includes a pair of scraper rollers 23, 23 made of rubber, plastic, ceramic or metallic material, and these scraper rollers 23, 23 are circumscribed with the reciprocating roller 18 at the downstream side of the ink applying roller 19 to scrape out the ink remaining on the outer peripheral surface of the reciprocating roller 18 to make it clean.

The ink scraped out by the scraper rollers 23, 23 of the scraper device 22 is transferred to a follower roller 24 to recover the ink, which is reused. The scraper rollers 23, 23 are rotated with rotating speeds different from that of the reciprocating roller 18 or with a relative speed difference in the same rotating direction for improving the ink scraping efficiency.

A doctor device 25 is further disposed on the roller top side of the ink applying 19 for scraping the print ink adhering to the roller 19 surface to make smooth the ink distribution along the width direction of the roller 19. The doctor device 25 is provided with a doctor blade 26 having a free end circumscribed with the top portion of the ink applying roller 19 on the roller rotating side having an acute angle. The doctor blade 26 scrapes out the print ink remaining on the plate cylinder 12 after the transfer thereon to make smooth the ink distribution in the width direction thereof. The doctor blade 26 is a cantilever type, made of rubber, plastic, ceramic or metallic material, having a blade front end which is press contacted to the roller surface of the ink applying roller 19 to scrape out the ink applied to the roller surface. The ink applying roller 19 is composed of a driving type rubber roller for the smooth driving thereof even when the doctor blade 26 contacts it.

The ink scraped out by the doctor blade 26 of the doctor device 25 is stored in an ink reservoir 28 disposed between the doctor blade 26 and an ink counterflow check blade 27, for example, on the top portion, as viewed, of the outer peripheral surface of the ink applying roller 19 opposite to the doctor blade 26 across a predetermined minute gap from the roller surface on the ;side where the roller rotates in the counter direction. Residual ink stored in the ink reservoir 28 is recovered into a recovery tank, not indicated, or the inkwell 11 to reuse the same.

Next, an operation of the inking arrangement 10 according to this embodiment will be described hereunder.

A printing ink stored in the inkwell 11 is extracted by the metallic ink delivery roller 13 and guided to the rollers of the inking roller train 14 one by one from the ink transfer roller 15. In the inking roller train 14, the printing ink is scoured by cooperative action of the scouring rollers 16 and 17 and the reciprocating roller 18 and is smoothed to have the ink concentration unified.

The printing ink is guided along the inking roller train 14 downward one by one, transferred to the ink applying roller 19 from the reciprocating roller 18 and is then scoured and applied to the plate cylinder 12 by the ink applying roller 19. The printing ink applied to the plate cylinder 12 is scoured uniformly by the inking roller train 14 and attached in a state which is free from ink unevenness.

The printing ink attached to the plate cylinder 12 is transferred onto a printing paper by applying a pressure to the printing paper fed to a plate surface of the plate cylinder 12, thus performing the printing operation.

Further, the inking arrangement 10 has the doctor device 25 provided on the top surface of the ink applying roller 19, and the ink remaining on the surface of the ink applying roller 19 is scraped out by the doctor blade 26 of the doctor device 25 after being transferred to the plate cylinder and then smoothed in the roller cross direction, thus preventing nonhomogeneous regions in concentration from arising due to the residual ink.

In the next process, a printing paper is applied to the plate surface of the plate cylinder 12 and a printing pressure is applied to the paper, thus performing the printing operation.

In this process, the inking arrangement 10 comprises the scraper device 22 being provided to the final stage side inking roller of the ink roller train 14, for example, the reciprocating roller 18. The printing ink remaining on the reciprocating roller surface is scraped out to make the surface clean, whereby a negative influence caused by the remaining ink can be obviated and clean printing with no ink contamination or stain can be realized.

The inking arrangement 10 is also provided with the doctor device 25 on the top portion of the ink applying roller 19 and the ink remaining on the roller surface of the ink applying roller 19 can be scraped out after the ink transfer onto the plate cylinder 12 by the doctor blade 26 of the doctor device 25 and the ink distribution thereon can be made smooth along the widthwise direction of the roller, thus preventing non-homogeneous concentrations regions from arising due to the residual ink.

The ink scraped out by the doctor blade 26 is stored in the ink reservoir 28 between the doctor blade 26 and the ink counterflow check blade 27, and the remaining ink is recovered in a recovery tank for a reutilization. On the other hand, the ink stored in the ink reservoir 28 is rescoured according to rotations of the ink applying roller 19, smoothed by the doctor blade 26 and unified in the roller cross direction. Thus, the roller surface in a state free from uneven ink concentration and drying can be formed. The ink scoured and unified by the inking roller train 14 is transferred to the surface of the ink applying roller 19 from the final stage side inking roller 18 of the inking roller train 14, thereby allowing the surface of the ink applying roller 19 before the transfer to the plate cylinder 12, to be smoothed with the ink free from an unevenness in concentration. Thus, a fine printing free from ink unevenness and stain may be applied to the printing paper to be printed by a plate surface of the plate cylinder 12. It is therefore pertinent to a high-level printing such as art printing or the like.

A second embodiment of an inking arrangement according to this invention will now be described hereunder with reference to FIG. 2.

Figure 2:
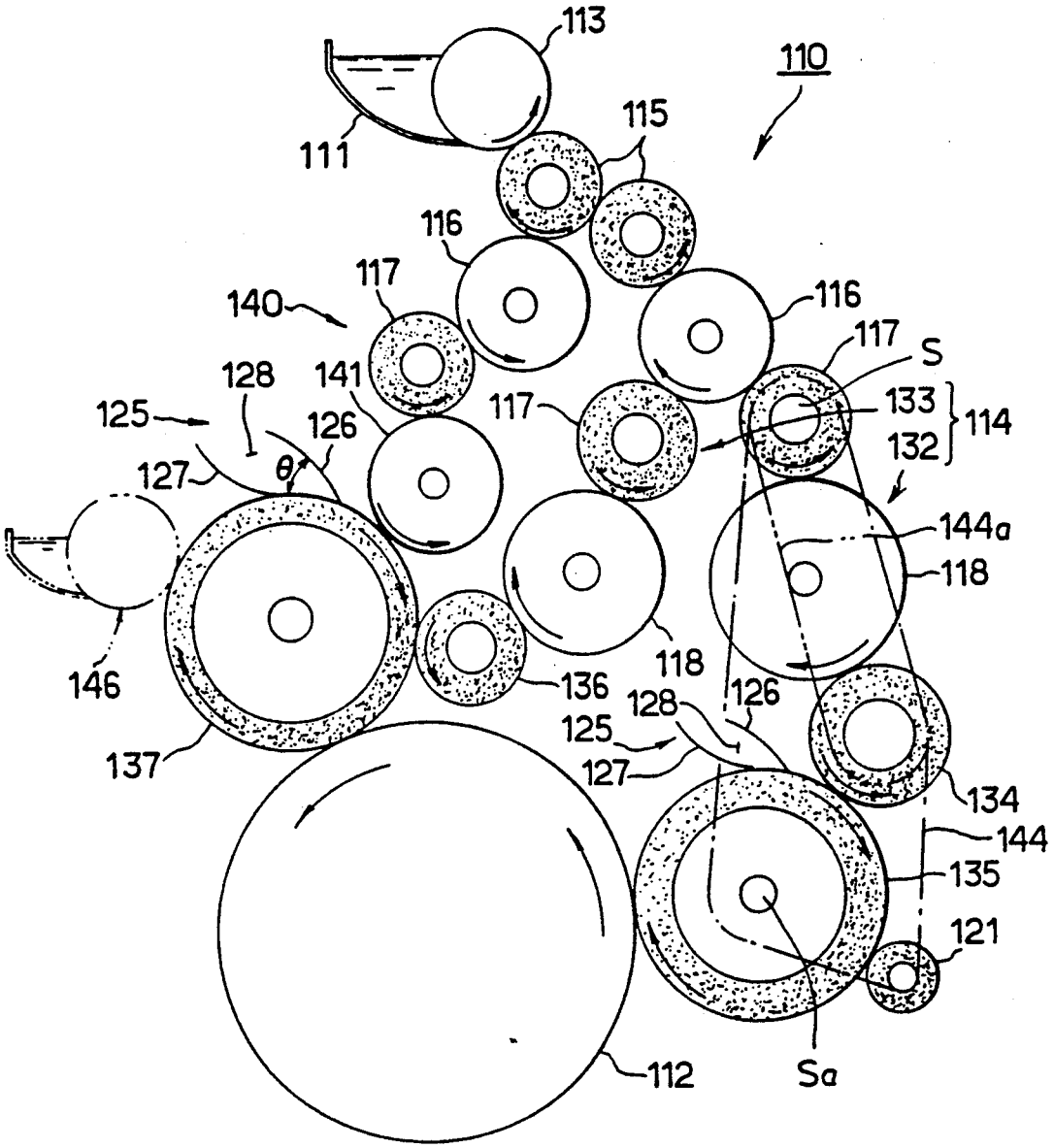
FIG. 2 is an illustrated arrangement representing a second embodiment of an inking arrangement according to this invention.

Referring to FIG. 2, in an inking arrangement 110, a printing ink stored in an inkwell 111 is scoured for transfer to a plate cylinder 112. The printing ink stored in the inkwell 111 is extracted by an ink delivery roller 113 and guided to an inking roller train 114 combining a plurality of inking rollers to function as ink scouring rollers and generally comprising inking trains 132 and 133 mentioned hereinlater. In consideration of a tack value, i.e. tackiness, of the printing ink and further taking roller scour and transferability of the ink into consideration, the inking roller train 114 includes fundamentally rubber rollers respectively and metallic rollers disposed alternately.

The rubber roller is that for which an iron core is covered with synthetic rubber, natural rubber or the like, the synthetic rubber employing mainly neoprene, thiokol and nitrile rubber superior in oil resistance.

The inking roller train 114 includes rubber ink transfer rollers 115 for transferring a printing ink extracted from the ink delivery roller 113 in a proper quantity, scouring rollers 116 and 117 for scouring the printing ink from the ink transfer rollers 115 to keep constant or stabilize the fluidity of the ink, a reciprocating roller 118 for reciprocating and smoothing the printing ink on the outer peripheral surface axially of the roller by a necessary width, and rubber ink applying rollers 135 and 137 for shifting the printing ink to the plate cylinder 112. The scouring rollers 116 and 117 are composed of a metallic roller 116 and an intermediate rubber roller 117, respectively. The hardness of the rubber roller is 30 to 40 degrees in the case where, for example, the scouring roller 117 is operating as a tumbling roller and 25 to 30 degrees in the case where the ink applying rollers 135 and 137 are operating as driving rubber rollers.

The reciprocating roller 118 is a driving metallic roller for scouring the printing ink axially of the roller and the metallic roller is reciprocated axially at a constant stroke.

The inking roller train 114 of the inking arrangement 110 is separated halfway into two or more systems, for example, traveling in the inking roller train 132 on a scouring side and the inking roller train 133 on a finishing side. The inking roller train 132 on the scouring side includes the rubber roller which is an inking roller 134 on a final stage side circumscribed with the scouring ink applying roller 135 and the inking roller train 133 includes the rubber roller which is an inking roller 136 on the final stage side circumscribed with the finishing ink applying roller 137. The ink scoured by the inking roller trains 132 and 133 is transferred to the plate cylinder 112 from smoothing ink applying roller 135 and the finishing ink applying roller 137.

The finishing ink applying roller 137 and the smoothing ink applying roller 135 are both formed of a driving rubber roller, thereby ensuring a smooth rotation of the ink applying rollers 135 and 137. These two rollers are circumscribed with the plate cylinder 112 as being spaced apart in the rotating direction thereof.

Further, for smoothing the roller surface before or after the ink is transferred and also for preventing an unevenness of concentration and drying of the roller surface, it is preferable that a roller 121 is provided on the ink applying rollers 135 and 137. The roller 121 may be a reciprocating roller for smoothing the ink.

In this embodiment, too, the smoothing ink applying roller 135 and the finishing ink applying roller 137 are provided with doctor devices 125, respectively. Each of the doctor devices 125 is provided so as to scrape out printing ink attaching on the outer peripheral surfaces of the ink applying rollers 135 and 137 and to smooth it in the roller cross-direction.

The doctor device 125 has a doctor blade 126 with its free end side circumscribed acutely at an angle $\theta$ on a side where the roller rotates forward from the top of the ink applying rollers 135 and 137 and scrapes out the printing ink remaining after being transferred to the plate sylinder 112 on the doctor blade 126, thereby smoothing it in the cross direction. The doctor blade 126 is made of rubber, plastic, ceramic or metal and is depressed against the nose portion of a cantilever blade so as to come in contact with the surface of the ink applying rollers 135 and 137. The ink applying rollers 135 and 137 are constructed of driving rubber rollers so as to be driven smoothly even when being depressed from contact by the doctor blade 126.

The ink scraped out by the doctor blade 126 of the doctor device 125 is stored in an ink reservoir 128 between the doctor blade 126 and an ink counterflow check blade 127. The ink counterflow check blade 127 is provided, for example, on top, as viewed, of the outer peripheral surfaces of the ink applying rollers 135 and 137 opposite to the doctor blade 126 across a predetermined minute gap from the roller surface on the side where the rollers rotate in counter directions. Residual ink stored in the ink reservoir 128 is scoured fine by rotations of the ink applying rollers 135 and 137, and then recovered into a recovery tank, not indicated, or the inkwell 111 for reutilization.

Meanwhile, when the printing ink is scraped out by the doctor blade 126 of the doctor device 125, the ink is capable of drooping due to exothermic action caused by friction. To prevent the ink from drooping, the ink applying rollers 135 and 137 have their surfaces cooled down by a water-cooled or oil-cooled cooling device, not indicated, to thereby keep a constant temperature. The cooling device circulates cooling oil or cooling water within the ink applying rollers 135 and 137.

On the other hand, a recovery inking roller 141 of a recovery inking roller train 140 is circumscribed rotatably with the finishing ink applying roller 137 on a side where the roller of the doctor device 125 rotates forward. The recovery inking roller 141 is formed of a reciprocating metallic roller, and the ink recovered by the recovery inking roller 141 is recovered in the ink transfer roller 115 of the inking roller train on the feed side by way of the recovery inking roller train 140 or in the inking rubber roller at a halfway point of the inking roller train 140.

The recovery inking roller train 140 comprises, in combination, the recovery inking roller 141 and recovery scouring rollers 116 and 117. The scouring roller 116 is a driving metallic roller, while the scouring roller 117 is a tumbling rubber roller. The ink recovered by the recovery inking roller 141 is recovered by way of the recovery inking roller train 140 and refed to the inking roller 114 on the feed side.

In a preferred modification of this embodiment, the inking roller train 132 arranged on the smoothing side is supported on a frame 144 as one unit to be rotatable, for example, around a spindle S of the scouring roller 117 or a spindle Sa of the ink applying roller 135. The doctor device 125 is arranged so as to be released by turning the inking roller train 132 on the smoothing side by a hand of an operator or any other mechanical means. Furthermore, the rollers 17, 18 and 34 may be supported by a frame 144*a* as one unit to be rotatable around the spindle S of the scouring roller 117, for example.

The inking arrangement 110 entails the work for changing an ink shade and also for washing the ink, and therefore, in such case, the working personnel must insert their hands into the doctor device 125 to proceed with wiping out the ink in a cleaning agent such as gasoline, petroleum or the like.

In the case of the smoothing side inking roller train 132, since the doctor device 125 is positioned in a limited space surrounded by the inking roller trains 132 and 133, a handling work of the doctor device 125 involves some difficulty, but the doctor device 125 is released and its handling is facilitated by arranging the smoothing side inking roller train 132 rotatable integrally by the frame 144 or 144*a*.

The doctor device 125 on a side of the finishing side inking roller train 133 is not positioned within a space surrounded by the inking roller trains, and therefore it need not be turned, and hence it is fixed on a frame.

Further, an auxiliary feeder 146 may be provided on the ink applying rollers 135 and 137 as indicated by a chain line in FIG. 2.

Next, an operation of the inking arrangement 110 according to this embodiment will be described.

A printing ink stored in the inkwell 111 is extracted by the metallic ink delivery roller 113 and guided to the inking roller train 114 one by one from the ink transfer roller 115. In the inking roller train 114 the printing ink is scoured by a cooperative action of the scouring rollers 116 and 117 and the reciprocating roller 118 and is smoothed to have a unified ink concentration.

The printing ink is guided to the rollers of the inking roller train 114 downward one by one, transferred to the ink applying rollers 135 and 137 from the reciprocating roller 118 and is then scoured and applied to the plate cylinder 112 by the ink applying rollers 135 and 137. The printing ink applied to the plate cylinder 112 is scoured uniformly by the inking roller train 114 (132, 133) to a fine ink grain and attached in a state free from ink unevenness.

The printing ink attached to the plate cylinder 112 is transferred onto a printing paper by applying a pressure to the printing paper fed to a plate surface of the plate cylinder 112 on a pressure plate cylinder not indicated, thus performing the printing operation.

Further, the inking arrangement 110 has the doctor devices 125 provided on top surfaces of the ink applying rollers 135 and 137, and the ink remaining on the surfaces of the ink applying rollers 135 and 137 is scraped out by the doctor blades 126 of the doctor devices 125 after being transferred to the plate cylinder 112 and then smoothed in the roller cross direction, thus preventing inhomogeneous regions in concentration from arising due to the residual ink.

Then, the ink scraped out by the doctor blade 126 is stored in the ink reservoir 128 between the doctor blade 126 and the ink counterflow check blade 127, and the remaining ink is recovered in a recovery tank for reutilization.

On the other hand, the ink stored in the ink reservoir 128 is rescoured according to rotations of the ink applying rollers 135 and 137, smoothed by the doctor blade 126 and unified in the roller cross direction. Thus, the roller surface in a state dry and free from uneven ink concentration can be formed. The ink scoured and unified by the inking roller train 114 is transferred at a degree of 30%, for example, to the surface of the ink applying rollers 135 and 137 from the final stage side inking roller 118 of the inking roller train 114, thereby allowing the surface of the ink applying rollers 135 and 137 before transfer to the plate cylinder 112 to be smoothed with the ink free from an unevenness in concentration and also being made uniform in concentration attached thereto. Thus a fine printing free from ink unevenness and stain may be applied to the printing paper to be printed by a plate surface of the plate cylinder 112. It is therefore pertinent to a high-level printing such as art printing or the like. The printing rate is, for example, 40 m/min. or 60 m/min.

Further, in the inking arrangement 110, after the ink is transferred to the plate cylinder 112, the ink remaining on the surface of the smoothing ink applying roller 135 is scraped out, smoothed and thus unified by the doctor device 125, the ink scoured by the smoothing inking roller train 132 is transferred smoothly to the unified surface of the smoothing ink applying roller 135 from the final stage side inking rubber roller 134, and the transferred ink is then transferred to the plate cylinder 112.

The inking arrangement 110 is provided with the finishing ink applying roller 137 on a side where the plate cylinder 112 rotates forward from the smoothing ink applying roller 135. While the finishing ink applying roller 137 transfers the ink to the plate cylinder 112, the ink remaining on the finishing ink applying roller 137 is scraped out by the doctor device 125, smoothed, thus unified further, and is then recovered by the recovery inking roller 141.

As described above, the surface of the finishing ink applying roller 137 is cleaned by the doctor device 125 and the recovery inking roller 141, thus preventing an unevenness of ink concentration. The ink scoured by the finishing inking roller train 133 is transferred uniformly to the surface of the finishing ink applying roller 137 free from the unevenness of concentration from the final stage side inking roller 136, and therefore the surface of the finishing ink applying roller 137 is cleaned to be free from ink unevenness and stain. As a result, the ink transferred to the plate cylinder 112 is unified to be free from an unevenness of ink concentration.

Figure 3:
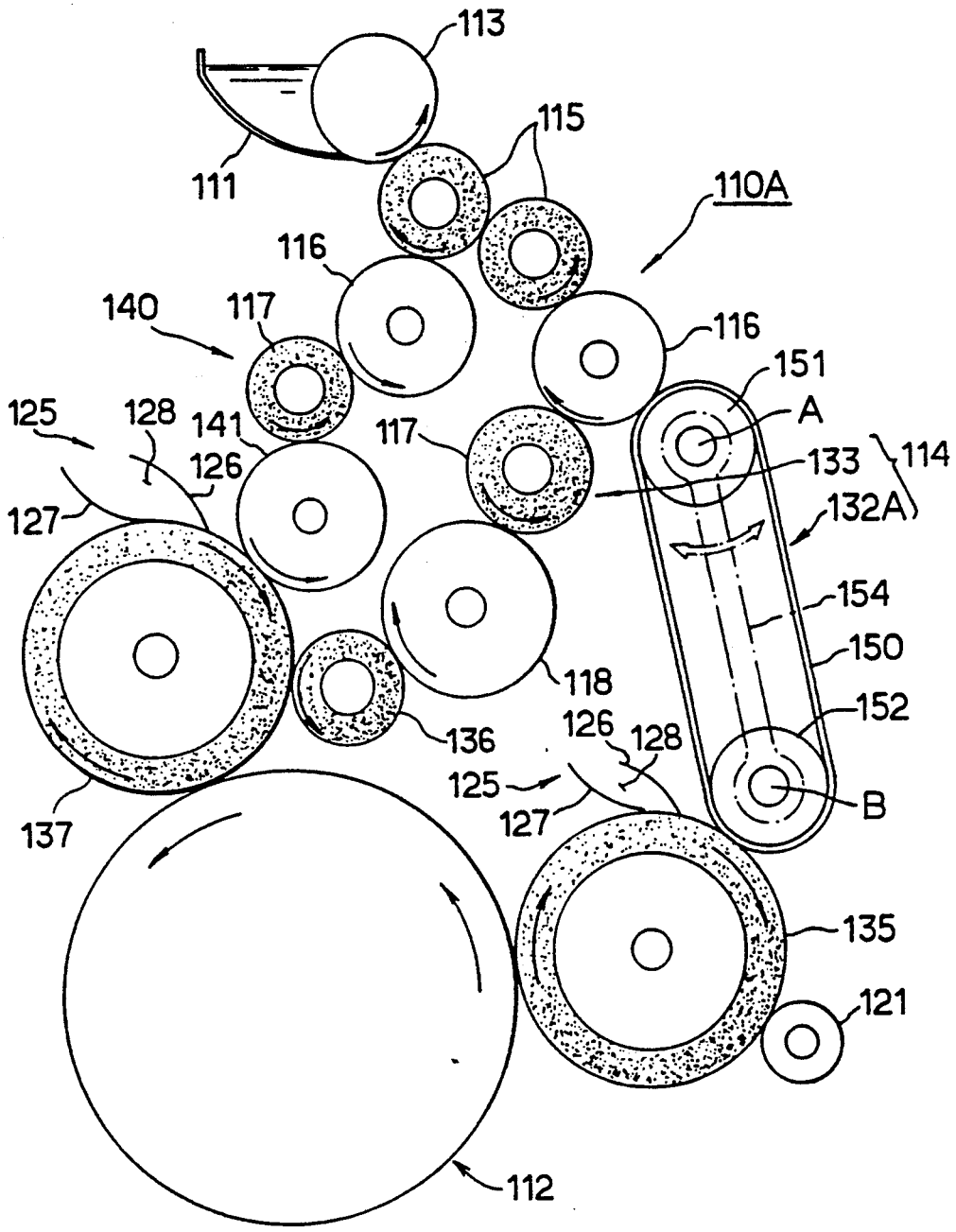
FIG. 3 is an illustrated arrangement representing a third embodiment of an inking arrangement according to this invention.

FIG. 3 represents a third embodiment of the inking arrangement relating to this invention.

An inking arrangement 110A according to this embodiment is similar to reference numeral 110 of FIG. 2 representing the second embodiment, except for that a smoothing side inking roller train 132A of the inking roller train 114 is different from that of FIG. 2. In FIG. 3, like reference numerals are added to elements or members corresponding to those of FIG. 2 and a further description will be omitted here.

Referring to FIG. 3, the inking arrangement 110A is provided with a flexible ink transfer belt 150 such as rubber or the like on the smoothing side inking roller train 132A, the ink transfer belt 150 being laid between both rollers 151 and 152. The rollers 151 and 152 are supported rotatably round a roller spindle A or B on a frame 154, and the doctor device 125 is released by turning the frame 154, thus smoothing the work for ink shade change or ink washing.

Further, the number of inking rollers can be minimized by employing the ink transfer belt 150 on the smoothing side inking roller train 132A, and despite decreasing the number of inking rollers. The merit is such that ink can be transferred to a distance. The similar effects to that of the foregoing second embodiment will also be realized in other respects.

In describing the embodiments of this invention, the inking roller train has been exemplified in FIG. 2 by a case where a double inking roller train is provided; however, the invention is not necessarily limited to the double inking roller train, and a combination of various types of inking rollers will be conceivable.

What is claimed is:

1. In an inking arrangement in which a printing ink supplied from an inking source to an inking roller is transferred to an ink applying roller through an inking roller train including a plurality of inking rollers and in which the printing ink is then transferred to a plate cylinder from the ink applying roller, the improvement wherein a doctor device is disposed above and in direct contact with a top portion of an outer peripheral surface of the ink applying roller, said doctor device being circumscribed with the top portion of the outer peripheral surface of the ink applying roller at an acute angle with the rotating direction of the ink applying roller to scrape off ink remaining on the outer peripheral surface of the ink applying roller and to clean the surface, and wherein said ink applying roller is formed as a driving roller made of rubber circumscribing with the final stage inking roller of the inking roller train, and said doctor device comprises a doctor blade circumscribing at an acute angle with the outer peripheral surface of the ink applying roller at the top portion thereof and an ink counterflow check blade disposed opposite to the doctor blade with space at a portion upward from the portion of the doctor blade contacting the surface of the ink applying roller in a roller counter-rotating direction so as to form an ink reservoir between the doctor blade and the ink counterflow check blade.

2. An inking arrangement according to claim 1, wherein said ink counterflow check blade has a front end positioned spaced from the outer peripheral surface of the ink applying roller.

3. An inking arrangement according to claim 1, wherein said doctor blade has a cantilever support structure.

4. An inking arrangement comprising:

an ink source in which a printing ink is stored;

an inking roller contacting the printing ink in the ink source;

an ink roller train contacting the inking roller, said ink roller train including an ink transfer roller contacting the inking roller for receiving the printing ink from the ink source, an ink scouring roller contacting the ink transfer roller for stabilizing the fluidity of the printing ink, a reciprocating roller contacting the scouring roller for smoothing the printing ink in a widthwise direction of the scouring roller, and an ink applying roller contacting the reciprocating roller and disposed in a final stage of the ink roller train;

a plate cylinder contacting the ink applying roller; and a doctor device disposed above a top portion of an outer peripheral surface of the ink applying roller, said doctor device being circumscribed with the top portion at an acute angle with the rotating direction of the ink applying roller to scrape off ink remaining on the outer peripheral surface of the ink applying roller as well as to clean the surface, said reciprocating roller being circumscribed with the outer peripheral surface of the ink applying roller at a portion further downward from a portion of the doctor device contacting the surface of the ink applying roller in the roller rotating direction thereof.

5. An inking arrangement according to claim 4, wherein said ink roller train comprises a plurality of inking rollers in combination with rubber rollers and metallic rollers arranged alternately.

6. An inking arrangement according to claim 4, further comprising a scraper device contacting the reciprocating roller for scraping off printing ink remaining on an outer peripheral surface of the reciprocating roller.

7. An inking arrangement according to claim 6, wherein said scraper device includes a pair of scraper rollers circumscribed with the outer peripheral surface of the reciprocating roller at portions downward from a portion contacting the ink applying roller in a rotating direction thereof and a follower roller contacting the scraper rollers for recovering the printing ink scraped off by the scraper rollers.

8. An inking arrangement comprising:

an ink source in which a printing ink is stored;

an inking roller contacting the printing ink stored in the ink source;

ink roller train means contacting the inking roller, said ink roller train means including an ink transfer roller contacting the inking roller for receiving the printing ink from the ink source, a smoothing ink roller train and a finishing ink roller train, said smoothing ink roller train comprising an ink scouring roller contacting the ink transfer roller for stabilizing the fluidity of the printing ink, a reciprocating roller contacting the scouring roller for smoothing the printing ink in a widthwise direction of the scouring roller, and a smoothing ink applying roller contacting the reciprocating roller through another inking roller and disposed in a final stage of the smoothing ink roller train, said finishing ink roller train comprising an ink scouring roller contacting the ink transfer roller, a reciprocating roller contacting the ink scouring roller for smoothing the printing ink in a widthwise direction of the scouring, and a finishing ink applying roller contacting the reciprocating roller through another inking roller and disposed in a final stage of the finishing ink roller train;

a plate cylinder contacting the smoothing ink applying roller and the finishing ink applying roller; and doctor devices disposed above outer peripheral surfaces of the smoothing and finishing ink applying rollers, said doctor devices being circumscribed with the outer peripheral surfaces of the smoothing and finishing ink applying rollers each at an acute angle with the rotating direction of the ink applying roller so as to scrape out an ink remaining on the outer peripheral surface of the ink applying roller as well as to clean the surface.

9. An inking arrangement according to claim 8, wherein each of said smoothing and finishing ink applying rollers is formed as a driving roller made of rubber circumscribed with the final stage inking roller of each of the smoothing and finishing inking roller trains and each of said doctor devices comprises a doctor blade circumscribing at an acute angle with the outer peripheral surface of the corresponding ink applying rollers and an ink counterflow check blade disposed opposite to the doctor blade with space at a portion upward from the portion of the doctor blade contacting the surface of the ink applying roller in a roller counter rotating direction so as to form an ink reservoir between the doctor blade and the ink counterflow check blade.

10. An inking arrangement according to claim 9, wherein said ink counterflow check blade has a front end positioned spaced from the outer peripheral surface of the ink applying roller.

11. An inking arrangement according to claim 9, wherein said doctor blade has a cantilever support structure.

12. An inking arrangement according to claim 8, wherein each of said smoothing and finishing ink roller trains comprises a plurality of inking rollers in combination with rubber rollers and metallic rollers arranged alternately.

13. An inking arrangement according to claim 8, further comprising an ink recovery roller train including an ink recovery roller contacting an outer peripheral surface of the finishing ink applying roller located on a rotating side thereof.

14. An inking arrangement according to claim 13, wherein said ink recovery roller train further includes an ink scouring roller contacting the ink recovery roller for smoothing the printing ink recovered from the finishing ink applying roller and wherein the printing ink recovered is supplied to the ink roller train means on a feed side from the ink scouring roller of the ink recovery roller train.

15. An inking arrangement according to claim 8, wherein the doctor device is surrounded by the smoothing ink roller train and the smoothing ink roller train is located in a unit attached to a frame member to be rotatable in a direction to outwardly release the doctor device on this train side.

16. An inking arrangement according to claim 15, wherein the frame is rotatably secured to a spindle of the ink scouring roller on the smoothing ink roller train.

17. An inking arrangement according to claim 8, wherein the ink scouring roller, the reciprocating roller and another inking roller of the smoothing ink roller train are located in a unit which is supported by a frame to be rotatable in a direction to outwardly release the doctor device on this train side.

18. An inking arrangement according to claim 17, wherein the frame is rotatably secured to a spindle of the ink scouring roller on the smoothing ink roller train.

19. An inking arrangement comprising:

an ink source in which a printing ink is stored;

an inking roller contacting the printing ink stored in the ink source;

ink roller train means contacting the inking roller, said ink roller train means including an ink transfer roller contacting the inking roller for receiving the printing ink from the ink source, a smoothing ink roller train and a finishing ink source, said smoothing ink roller train comprising an ink scouring roller contacting the ink transfer roller for stabilizing the fluidity of the printing ink, a smoothing ink applying roller disposed in a final stage of the smoothing ink roller train and an ink transfer belt means disposed between the ink scouring roller and the ink applying roller of the smoothing ink roller train, said belt means comprising a first roller contacting the ink scouring roller, a second roller contacting the smoothing ink applying roller, a belt stretched around outer peripheral surfaces of the first and second rollers to be rotatable so as to transfer the printing ink from the ink scouring roller to the smoothing ink applying roller through a rotation of the belt, and a frame member connecting the first and second rollers, said finishing ink roller train comprising an ink scouring roller contacting the ink transfer roller, a reciprocating roller contacting the ink scouring roller for smoothing the printing ink in a widthwise direction of the scouring, and a finishing ink applying roller contacting the reciprocating roller through another inking roller and disposed in a final stage of the finishing ink roller train;

a plate cylinder contacting the smoothing ink applying roller and the finishing ink applying roller; and doctor devices disposed above outer peripheral surfaces of the smoothing and finishing ink applying rollers, said doctor devices being circumscribed with the outer peripheral surfaces of the smoothing and finishing ink applying roller each at an acute angle with the rotating direction of the ink applying roller so as to scrape out ink remaining on the outer peripheral surface of the ink applying roller as well as to clean the surface.

20. An inking arrangement according to claim 19, wherein said belt means is composed in combination as a unit to be rotatable in a direction to outwardly release the doctor device on the smoothing ink roller train.

21. An inking arrangement according to claim 20, wherein said belt means is rotatable about a spindle of the first or second roller.

22. An inking arrangement according to claim 19, wherein each of said smoothing and finishing ink applying rollers is formed as a driving roller made of rubber circumscribed with the final stage inking roller of each of the smoothing and finishing inking roller trains and each of said doctor devices comprises a doctor blade circumscribed at an acute angle with the outer peripheral surface of the corresponding ink applying rollers and an ink counterflow check blade disposed opposite to the doctor blade with space at a portion upward from the portion of the doctor blade contacting the surface of the ink applying roller in a roller counter rotating direction so as to form an ink reservoir between the doctor blade and the ink counterflow check blade.

23. An inking arrangement according to claim 19, wherein said ink counterflow check blade has a front end positioned spaced from the outer peripheral surface of the ink applying roller.

24. An inking arrangement, according to claim 23, wherein said doctor blade has a cantilever support structure.

25. An inking arrangement according to claim 19, further comprising an ink recovery roller train including an ink recovery roller contacting an outer peripheral surface of the finishing ink applying roller located on a rotating side thereof.

26. An inking arrangement according to claim 25, wherein said ink recovery roller train further includes an ink scouring roller contacting the ink recovery roller for smoothing the printing ink recovered from the finishing ink applying roller and wherein the printing ink recovered is supplied to the ink roller train means on a feed side from the ink scouring roller of the ink recovery roller train.

* * * * *